US006415211B1

(12) United States Patent
Kotlow

(10) Patent No.: US 6,415,211 B1
(45) Date of Patent: Jul. 2, 2002

(54) WEAPON AND LAUNCHER TEST SET (WALT)

(75) Inventor: Dominik A. Kotlow, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/606,104

(22) Filed: Jun. 9, 2000

(51) Int. Cl.[7] ..... G06F 7/00

(52) U.S. Cl. ..... 701/35; 701/36; 73/167; 89/1.8; 89/1.809; 89/5; 102/399

(58) Field of Search ..... 701/35, 36; 73/167; 89/1.8, 1.809, 5; 102/399; 114/18

(56) References Cited

U.S. PATENT DOCUMENTS 6,367,851 B1 * 5/2000 Chaves et al. ..... 73/167

* cited by examiner

*Primary Examiner*—Yonel Beaulieu
(74) *Attorney, Agent, or Firm*—Michael J. McGowan; Prithvi C. Lall; Michael F. Oglo

(57) ABSTRACT

A portable data acquisition system for use in certifying torpedo tube-launched weapons such as a Mark 48/ADCAP, a Tomahawk missile or a Harpoon and the like. The system includes a portable computer, a rugged four slot chassis, a 32 channel multiplexing module, a four channel isolation amplifier with excitation, eight channel isolation amplifier, a custom signal conditioning module, an associated terminal block and interface cables. The system has the unique feature of obtaining live data for quick analysis about the launched weapon using the torpedo tube as opposed to the post launch data for analysis. All the components are housed in a shock resilient and weather-tight container.

21 Claims, 6 Drawing Sheets

WEAPON AND LAUNCHER TEST SET (WALT)

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to the field of weapons test equipment and in particular to testing and monitoring of combat, weapon and launch transient signals for submarine-launched weapons.

(2) Description of the Prior Art

Shipboard and submarine-launched weapons use data and electrical communications with the ship's systems to provide location, navigation, targeting and fuzing/yield data. In order for these weapons to operate properly it is necessary to test all data and electrical interface signals and to test internal weapon guidance and operating systems. Special test equipment has been designed to monitor combat, weapon and launched transient signals and are necessary to certify launched system readiness. The MK 617 Launched System Test Set (LSTS), Quick Look Launcher Test Set (QLLTS), and the MK 621 Torpedo Tube Instrumentation (TTI) have been used for over thirty years to perform this certification. Certain disadvantages of the current equipment are becoming pronounced. As a result of time and heavy usage, these special test equipment systems are experiencing numerous component failures. Many of the components are antiquated and cannot be fixed or replaced. Custom repairs are possible, but are both expensive and time consuming. The recorders on the special test equipment systems are heavy and bulky. As a result, the test systems are unwieldy and difficult to hand-carry, especially passing through relatively small submarine hatches. Further, the data traces generated with these recorders are imprinted on expensive, light sensitive paper, which deteriorates over time, thereby destroying any record of the weapons launch. Also, analysis and reporting on launch data traces with existing test systems are not immediately available. Instead, the data traces from recorders must be manually reduced and analyzed, a time intensive process subject to human error and inconsistent interpretation. Along with the aging test equipment, weapons and launching systems are becoming increasingly complex. A need exists for test systems to flexibly and accurately monitor additional signals, such as the new signals driven by recent Harpoon, Tomahawk, and Seawolf weapons requirements.

SUMMARY OF THE INVENTION

Accordingly, it is an object of the invention to provide a ruggedized, portable data acquisition system having a lightweight and compact form suitable for hand-carrying in confined shipboard spaces.

It is another object of the invention to provide a portable data acquisition system which produces an immediate readout and interpretations of data traces.

It is yet another object of the invention to provide a portable data acquisition system which is fabricated using off-the-shelf, commercially available notebook computers.

It is a further object of the invention to provide a portable data acquisition system which can be reprogrammed to monitor different or new signals as needed.

The invention is a portable data acquisition system comprising a portable computer using PCMCIA data acquisition card (DAQCard 1200), rugged four slot chassis (SCXI 1000), multiplexing amplifier (SCXI 1102C), four channel isolation amplifier with excitation (SCXI 1121), eight channel isolation amplifier (SCXI 1120) and associated terminal blocks and interface cables. All components are housed in a shock resilient and weather tight case. Power is supplied to the case through a standard AC outlet and is distributed to the PC and signal-conditioning unit. The portable computer is located in the upper half of the case, while the signal-conditioning unit is located in the bottom portion. Cable connections are located on a removable panel on one side of the case. The sensor cable mates directly to existing MK 617 ancillary equipment such as the Pressure Velocity Displacement (PVD) assembly and related components, B—B and BBY's etc. In addition, a new sensor cable is included. This cable has additional conductors which enable all ADCAP, Harpoon, and Tomahawk signals to be received without the use of adapters. In addition, the sensor cable can also be connected to the MK 617; PVD Housing Assembly, guidance wire cable, fire solenoid inductive pick-up coil, and BBY adapter. An additional cable routes Turbine Pump Ejection System (TPES) rpm signal to the portable data acquisition system. The system includes software written in LabVIEW for Windows™, a visual programming language development by National Instruments Company. A variety of tasks are presented by a main menu which include data acquisition for the MK48/ADCAP or Harpoon/Tomahawk of signals post processing calibration, and real-time signal display for trouble shooting. Weapon specific signals are acquired and displayed along with pertinent signal event timing (automatically computed).

BRIEF DESCRIPTION OF THE DRAWINGS

The foregoing objects and other advantages of the present invention will be more fully understood from the following detailed description and reference to the appended drawings wherein.

DESCRIPTION OF THE PREFERRED EMBODIMENTS

Figure 1:
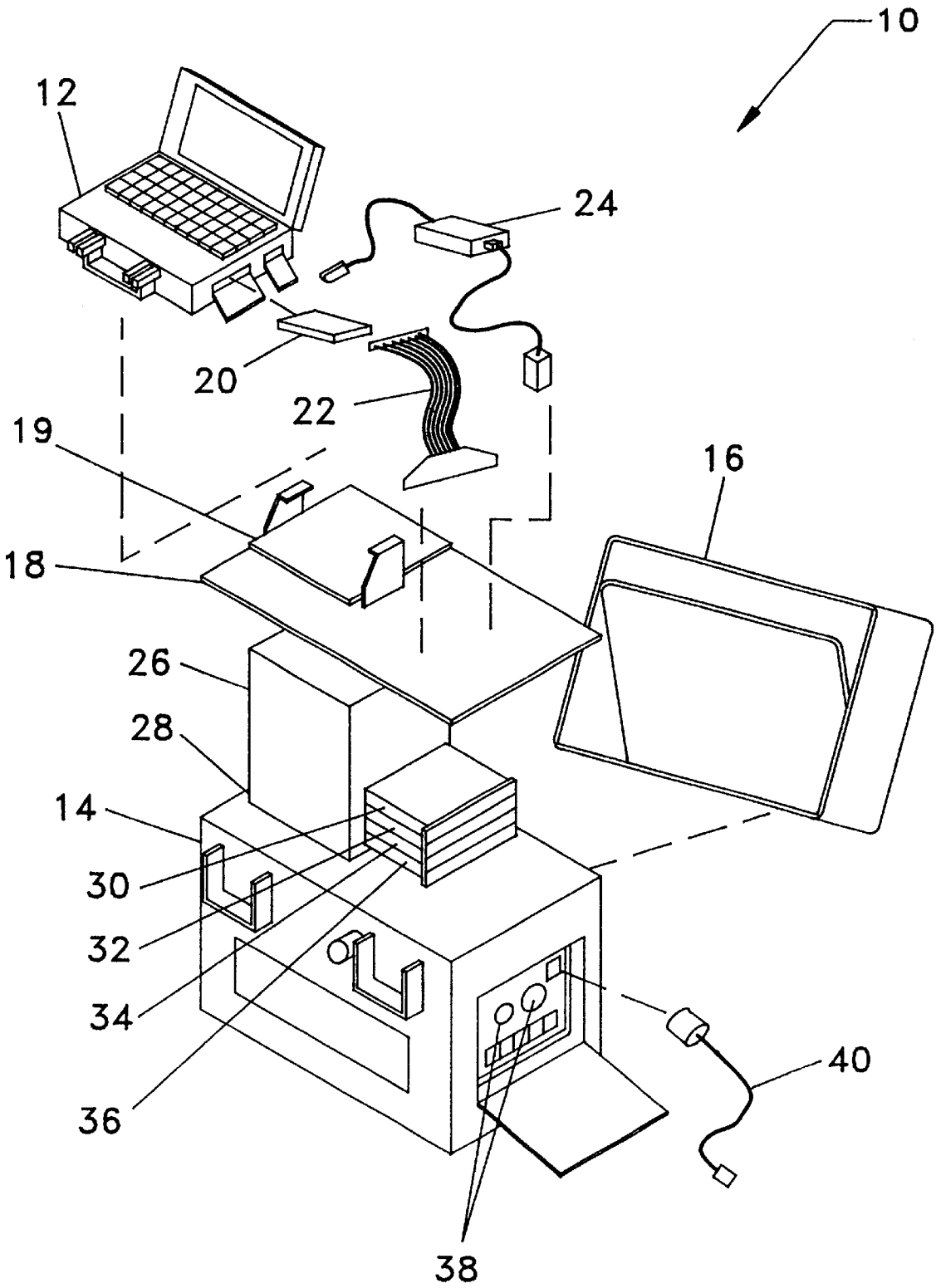
FIG. 1 is an exploded perspective view of the overall portable data acquisition system.

Referring now to FIG. 1, the overall portable data acquisition system, designated generally by the reference numeral 10, is shown with its major components. The portable data acquisition system 10 is operated by a portable computer 12 which, along with the other system components, is packaged in the protective case 14, and is protected during transport or non-use by the protective lid 16. The protective case 14 is divided internally by a removable panel 18 between the upper section, containing the portable computer 12, and the lower section containing signal conditioning components and cable interface. The shock mount and portable computer 12 hold-down tray is mounted to the panel 18, various connectors for the AC power adapter 24, which provides DC power to the portable computer, and the PCMCIA card 20 with the connecting interface cable 22. The removable panel 18 also has switches and controls to power up an AC outlet and the lower section equipment. This equipment includes the signal-conditioning unit 26 which is mounted on a shock isolation plate 28 which is fastened to the bottom of the case. The signal-conditioning unit 26 has a plurality of signal processing modules having for sub-components, the 32-channel multiplexer 31, the 4-channel amplifier with excitation 32, the signal conditioning module 34, and the 8-channel isolation amplifier 36. A ribbon cable 31 connects the multiplexer to the data connector on the removable panel 18. Terminal block connectors are used to interconnect the 4-channel amplifier 32, the signal conditioning module 34, and the 8-channel isolation amplifier 36 to the external data cable connectors 38 on the side of the case 14. AC power is provided by the power chord 40. In the preferred embodiment, the portable computer 12 is a personal notebook computer. Any Pentium™ 75 MHz or greater may be used, however a ruggedized computer such as the Panasonic CF25™, will provide additional longevity.

Figure 2A:
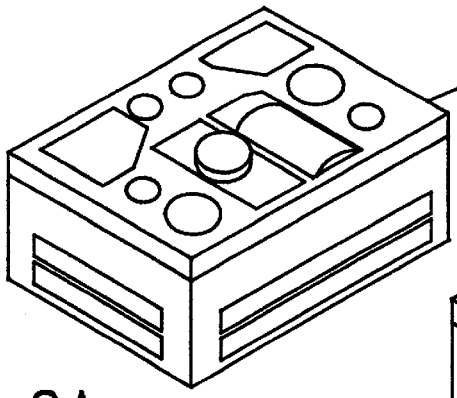
FIG. 2A PRIOR ART
FIGS. 2A and 2B are perspective view of the system according to subject invention.
Figure 2B:
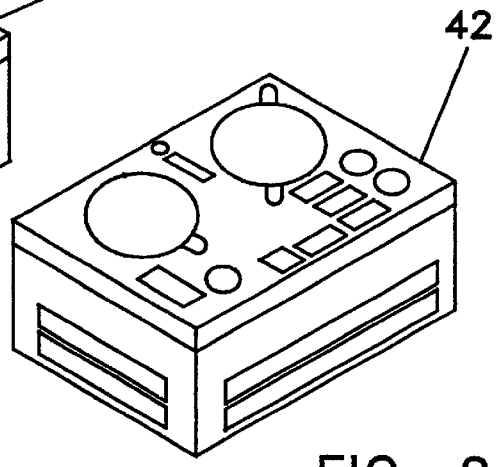
Figure 3A:
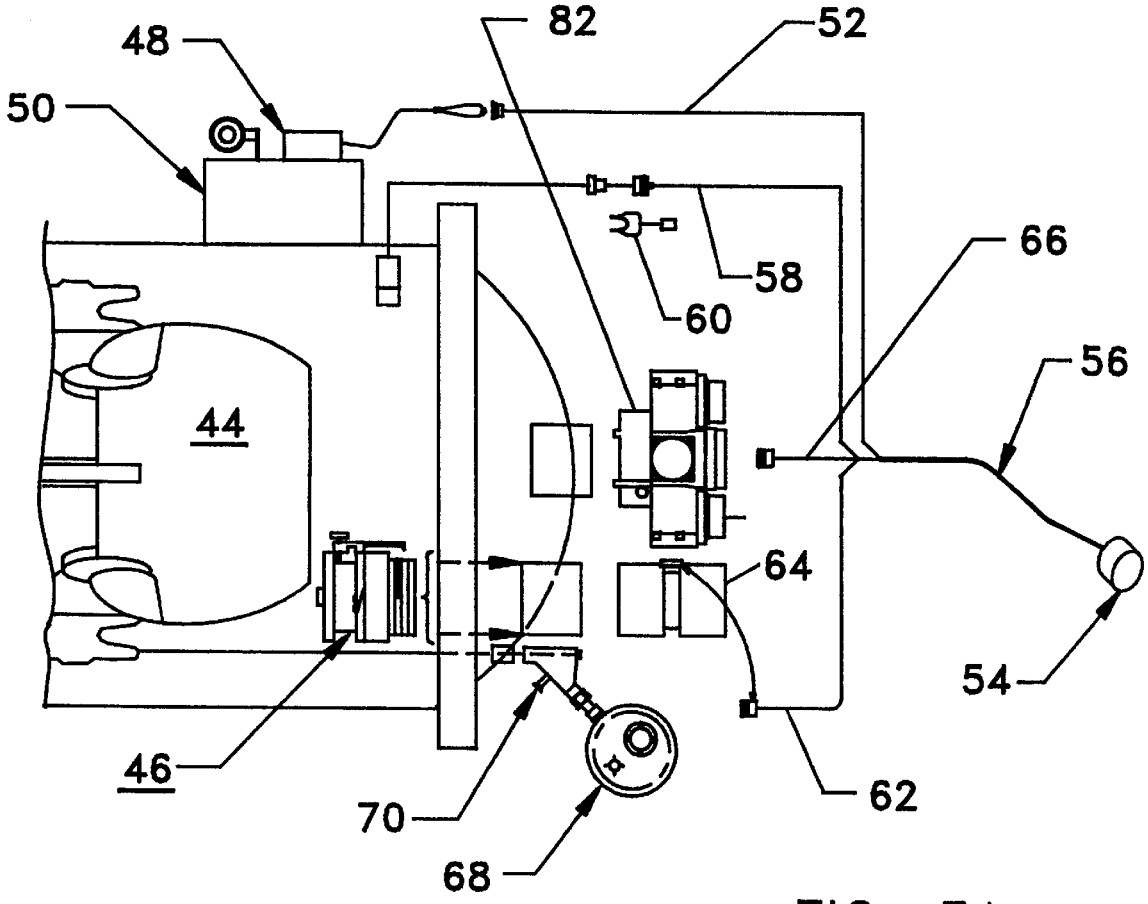
FIGS. 3A and 3B are schematic representations of a torpedo component and signal interface with the portable data acquisition system according to the teachings of subject invention.
Figure 3B:
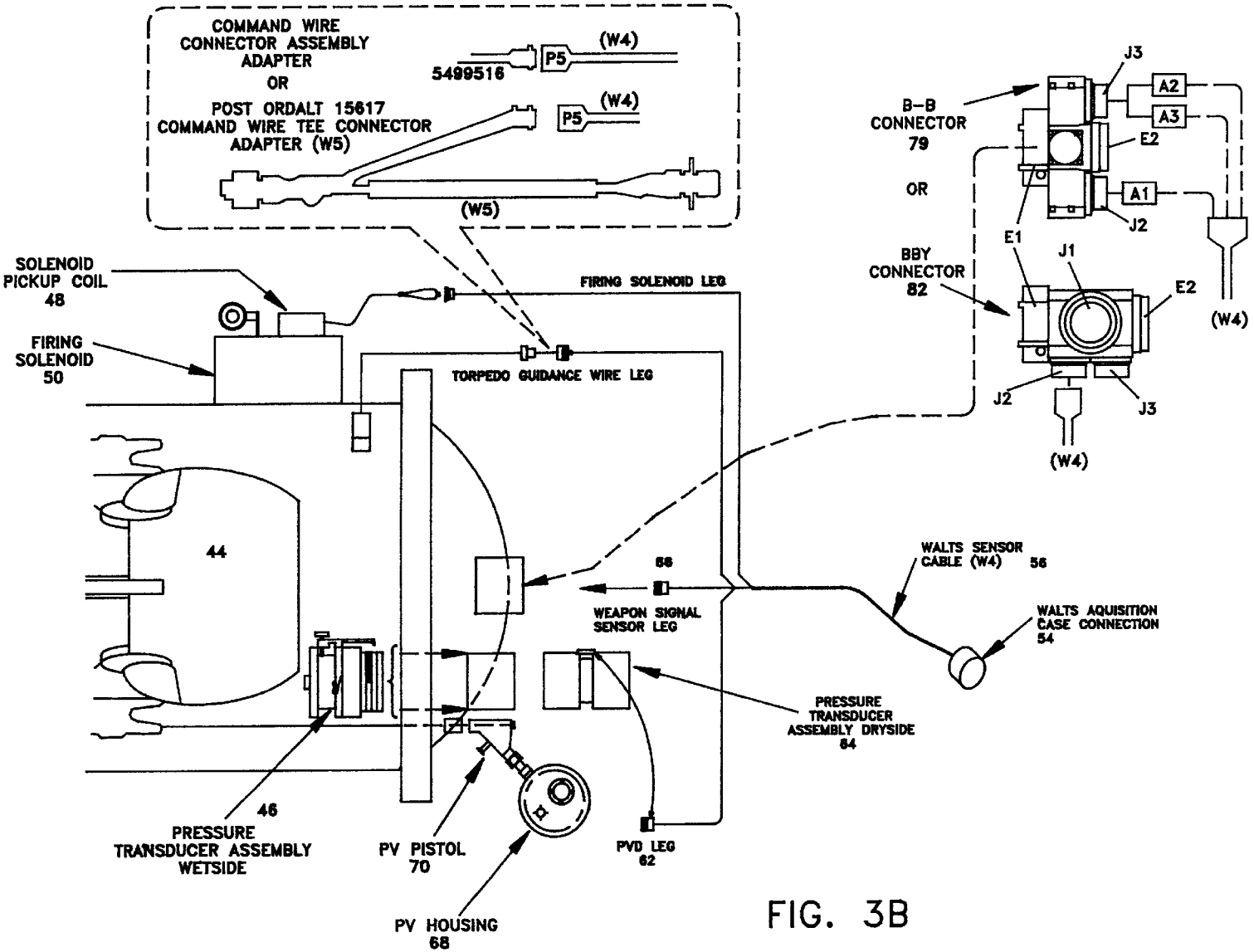

FIG. 2 shows existing ancillary MK 617 components 40 and 42 which can be used with the new portable data acquisition system 10. FIG. 3 is a schematic showing the aft end of a torpedo 44 in firing position in a torpedo tube. The portable data acquisition system 10 (not shown) is attached to connector 54 which connects by sensor cable 56 to the various signal sources. Ancillary components, shown for reference, are the wetside pressure transducer assembly 46, the dryside pressure transducer assembly 64, the PVD housing assembly, 68 and the PV pistol 70. On the top side of the tube, the firing solenoid 50 and the solenoid pick-up coil 48 are shown. The portable data acquisition system is connected to these various components by the various connectors, the firing solenoid leg 52, the torpedo guidance leg 58, the Post Ordalt 15617 guidance wire connector 60, the weapon and fire control signal sensor leg 66, connecting to the B—B or BB-Y connectors 82, and the pressure velocity displacement (PVD) leg 62.

The acquisition and post processing software was written in "LabVIEW for Windows™", a visual programming language developed by National Instruments. When run, the Main Menu is displayed. A variety of tasks are presented which range from:

Acquire Data-Acquires processes Mk48/ ADCAP, or Tomahawk data. When the acquisition routine is run scaled, signal voltages, frequencies, and various timing parameters required for torpedo tube certification are automatically displayed. The data collected is stored in a file consisting of ASCZZ text followed by binary signal data. The ASCII text header contain: Various run and test configurations, timing results, Channel Calibrations. Results for each run are automatically logged for future reference. The below table summarizes the signals acquired by the system for various weapon systems.

SIGNAL ACQUISITION

WALTS is currently capable of acquiring the following signals:

| FIRE CON-TROL | WEAPON SIGNALS | WEAPON | LAUNCH TRAN-SIENTS |
|---|---|---|---|
| IMPULSE RETURN | FIRE ORDER | | FIRING SOLENOID |
| IDENT PWR | MAIN MOTOR START | | BRCH DOOR PRES. |
| SERVICE | GUIDANCE WIRE | MK | TORPEDO |

-continued

| FIRE CON-TROL | WEAPON SIGNALS | WEAPON | LAUNCH TRAN-SIENTS |
|---|---|---|---|
| POWER +MIS-SILE IDENT PWR | ACABLE SRVER | 48/ADCAP | VEL. TORPEDO ACCEL. |
| | 28VDC POWER | | TORPEDO DISPL. |
| | MONITOR | | TPES PUMP SPEED |
| | IDENT BIT 1 | | |
| | BOOSTER SAFED CMD | | |
| | CMGS REPROGRAM CMD | | |
| | REM ABORT CMD | | |
| | PCM INSTRUMENTATION | TOMAHAWK | |
| | +BOOSTER SAFED MON. | | |
| | +SIMULATOR PRESENT | | |
| | +DC MON/RESET PWR | | |
| | +INTENT TO LAUNCH | | |
| | +MISSILE ENABLED | | |
| | +BOOSTER ARMED MON. | | |
| | +MISSILE BUS MON | | |
| | +BATTERY HEATER PWR | | |
| | MGU SEEKER/HEATER | | |
| | MISSILE PRESENT | | |
| | CAPSULE SAFE CMD | | |
| | TELEMETRY ON/OFF | | |
| | STB STEEROFF | +HARPOON | |
| | PORT STEEROFF | | |
| | AN/BSY-2 FLOOD | | |
| | AN/BSY-2 ABORT | | |

NOTE:
+INDICATES THE SIGNAL ALSO APPLIES FOR HARPOON WEAPONS

Reprocess Data-Looks for archived data and allows new calibrations to be applied to the raw data set. This data can be processed and displayed.

Calibrate-Captures and processes calibration data of transducers and other signals (pressure transducer, tachometers, etc.). Calibrates transducers, tachometers, and voltage sources. Obtains correct relationship between the raw signal (volts) and engineering units (psi, ft/s).

Transfer Data to EXCEL™, Transfers the following timing parameters to EXCEL™ spreadsheet:

Firing Volts to Impulse Return
Weapon Launch Switchboard Switch Box Time
Impulse return to Main Motor Start
Main Motor Start Duration
Firing Solenoid to End of Service Power
Peak Tube Door Pressure
Ram cycle Time (for Ram Pump Ejection System)
Torpedo exit velocity
Peak torpedo acceleration And the peak signal frequencies of the following signal:

Firing Volts
Impulse Return
Main Motor Start
Guidance Wire

Figure 4:
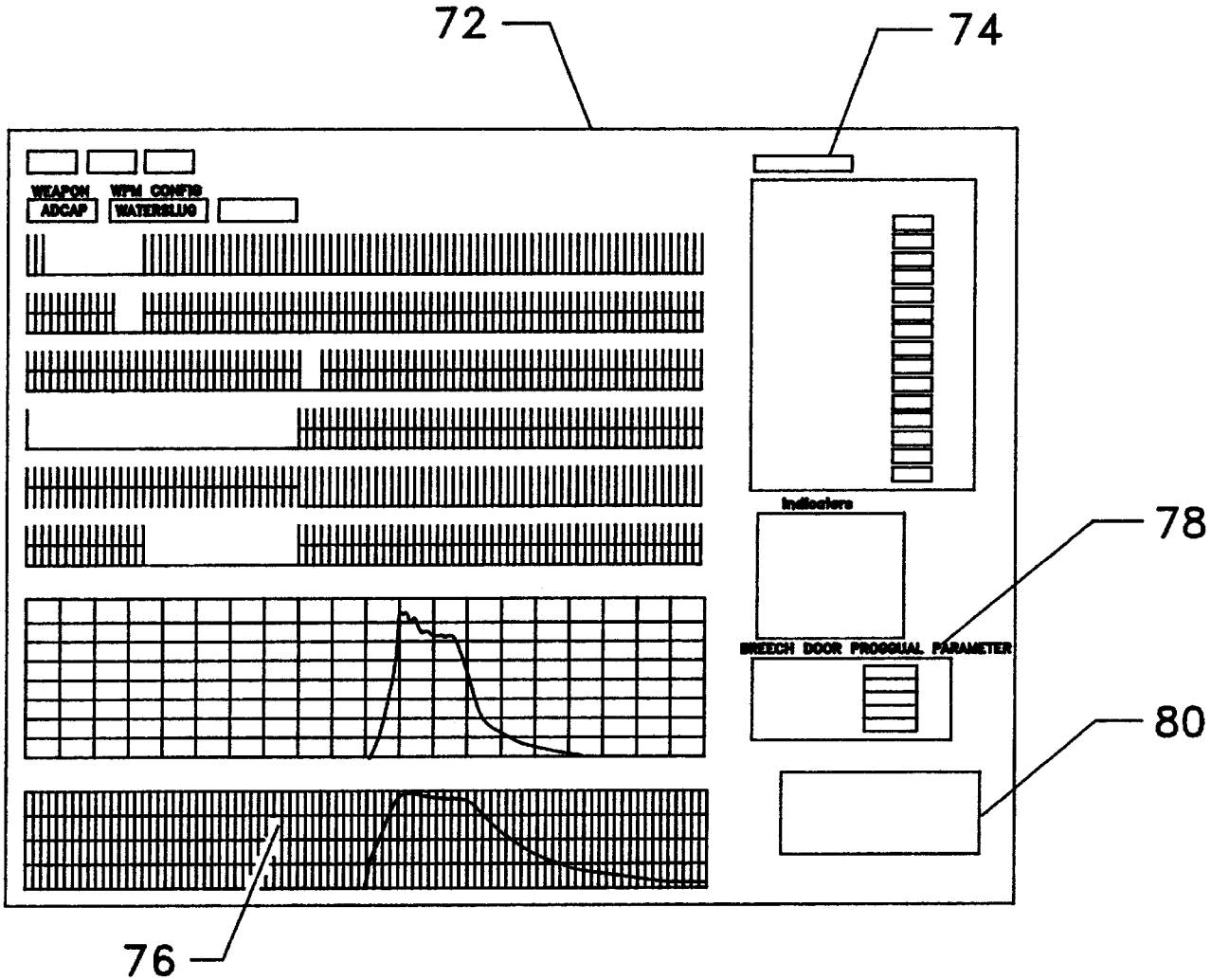
FIG. 4 is a typical data trace for a MK 48 ADCAP Launch.
Figure 5:
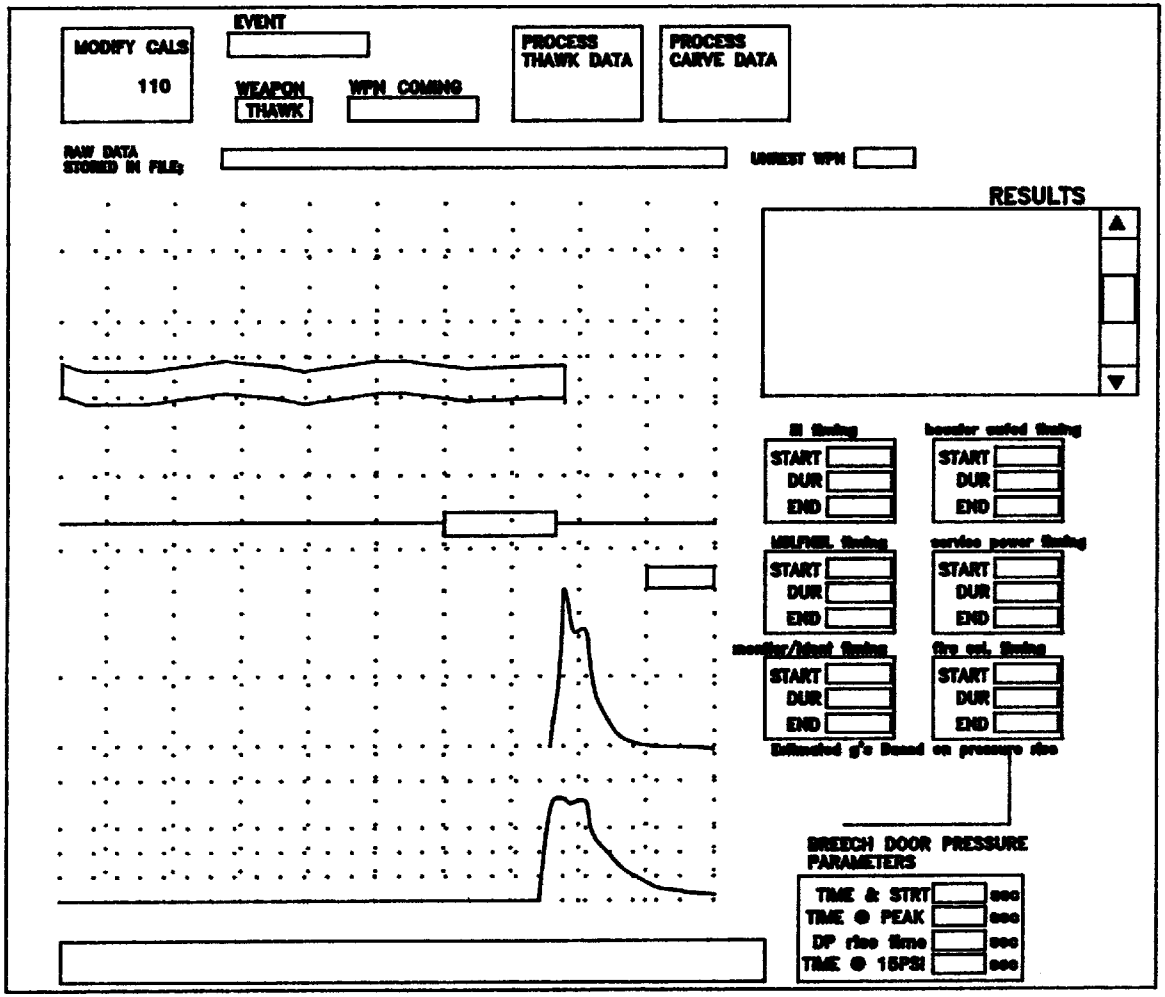
FIG. 5 is a typical data trace for a Tomahawk Launch.
Figure 6:
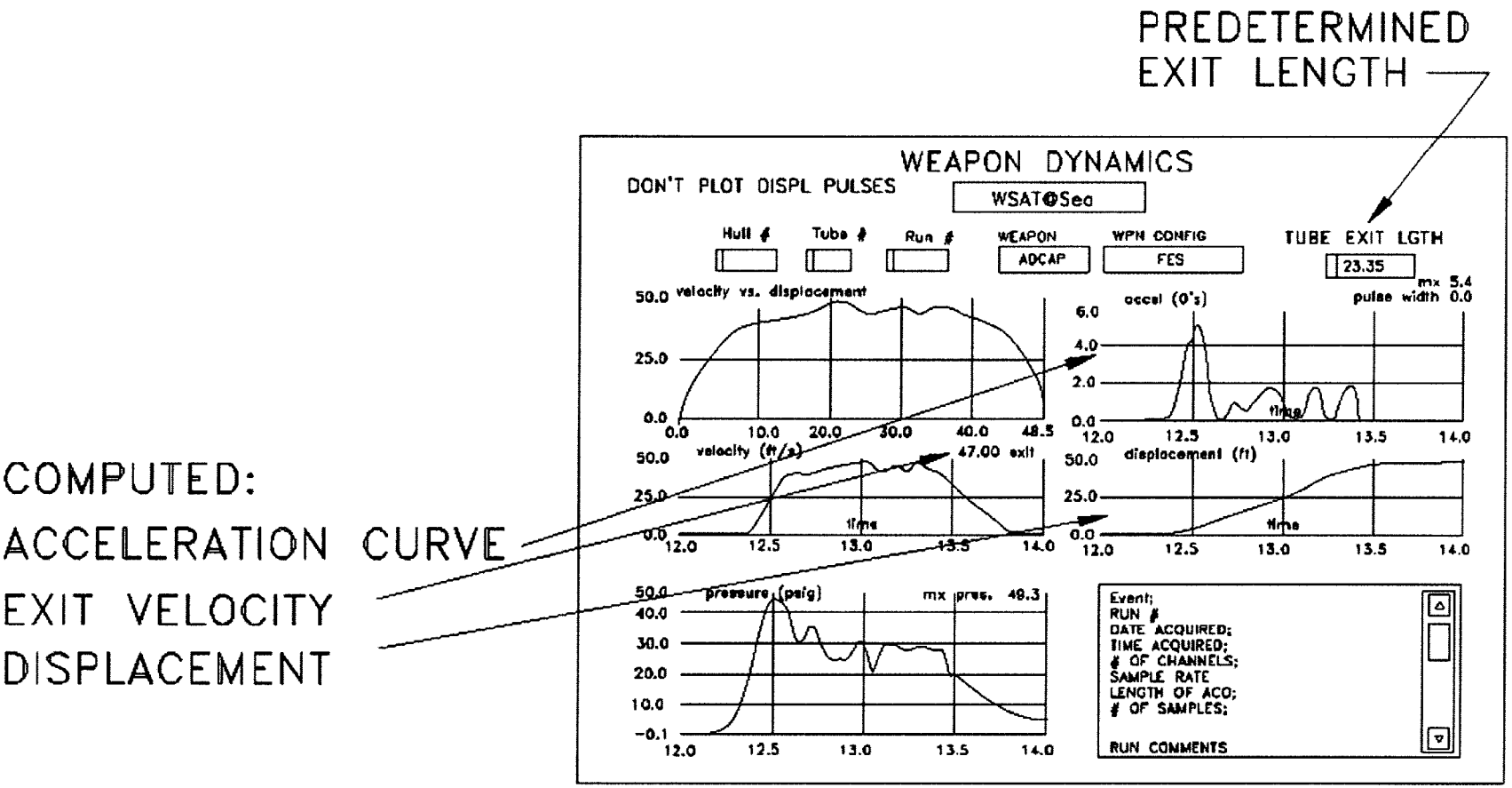
FIG. 6 is a typical data trace for a shape launch.

FIG. 4 displays a typical post processing screen 72 for either MK 48 or ADCAP weapons. The data acquired is processed and plotted in real time. After the acquisition is complete, cursors can be brought up to track signals and zoom-in on any part of any of the captured signals. Based on the current sample rate (800 Hz), one could zoom-in on any of the plots, and view data to within 1.25 ms resolution.

Timing parameters 74 are automatically computed and displayed as shown on the right side of the screen. The "Indicators" box displays green dots for every signal which falls within acceptable voltage range per specifications. "Breech Door Parameters" box 78 displays: TIME@STRT (time at which breech door pressure starts to rise), TIME@PEAK (time at which peak door pressure occurs), MAX PRES (maximum breech door pressure), DT (time difference between TIME@PEAK and TIME@STRT, and TIME@ 15 PSI (the time at which 15 psi occurs). The small chart 80 on the bottom right indicates an estimate of peak acceleration that would be achieved if a Mk48/ADCAP was launched.

Raw data files for each run are automatically stored on the hard drive in a path created by the information entered by the user about the specific platform. Data is therefore stored in a directory dictated by Hull No.\Date\Weapon\Tube No.\Run No. which the user could post process at a later date. The raw data file consists of an ASCII text header containing the run summary and channel calibrations followed by binary multiplexed channel data, thereby minimizing storage requirements.

The portable data acquisition system 10 automatically determines and stores the followings parameters:

Timing Parameters:
- Fire Order to Impulse Return
- Weapon Launch Switchboard Switch Box Time
- Firing Solenoid to End of Service Power
- Impulse Return to Main Motor Start
- Main Motor Start Duration
- Unrestrained Weapon Time
- 15 psig Indication Other Parameters:
- Torpedo exit velocity
- Peak torpedo acceleration
- Peak tube door pressure
- Estimate of Peak Torpedo Acceleration (based on breach door pressure correlation)

and automatically determines the peak signal frequencies of:
- Impulse Return
- Main Motor Start
- Guidance Wire The above parameters obtained with previous test sets (QLLTS, Mk617, TTI) had to be manually measured with calibrated scales and interpreted. The portable acquisition system reduces these parameters automatically with the following advantages:
- No calibrated scales required
- Immediate results not subject to interpretation
- Eliminates manual processing minimizing human error
- Provides consistent, accurate results in a fraction of time required Mk617, QLLTS, TTI.

The features and advantages of the invention are numerous. Data acquisition/post processing can be be performed in a user-friendly PC Windows™ environment. In the present invention data reduction/post processing is fully automated. Engineering plots are automatically generated displaying the signal-time history, peak voltages, frequencies, and critical signal timing parameters. This display eliminates the laborious and time-consuming task of manually determining peak data values from calibrated scale strip charts and provides fast, consistent, and accurate results in a fraction of time required by either Mk 617, TTI or QLLTS as well as minimizing human error and TTI or QLLTS as well as minimizing human error and inconsistencies due to interpretation while dramatically speed up data analysis and reporting. Raw and reduced data is automatically stored in magnetic media in appropriate directories for easy access/retrieval and can be readily transferred to any other PC for dissemination or further post processing. The present invention can acquire up to 44 channels of data, a significant increase over the LSTS. The LSTS only has 18 channels, which is more than either TTI or QLLTS systems. Data is always readily available if needed for further processing.

The displayed results can be printed on plain paper, thereby eliminating the use of expensive, unstable, light sensitive paper used by existing LSTS, TTI, and QLLTS systems. WALTS can be operated by a commercial off-the-shelf system such as any Pentium™ 75 MHz notebook PC with PCMCIA Type II slots and "Windows 95™" operating system with a minimum of 24 megabytes of RAM. Down time due to PC failures is minimized since many suitable substitutes exist. As nearly all of the electrical parts are Commerial-off-the-shelf (COTS) component availability is improved and system costs are minimized.

Further, the components of the present invention are modular and easily replaced if damaged. The current system is 50% smaller and lighter than the LSTS recorder, which it replaces. In the present invention, the system channel count can be expanded by adding another PCMCIA data acquisition card. The WALTS sensor cable contains additional conductors to anticipate future Harpoon, Tomahawk and Seawolf requirements and are field repairable with splash proof back-shells.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A portable live data acquisition system for certifying launch system readiness on shipboard and submarine-launched weapons comprising:
- a protective case having a cover;
- a removable panel located within said case and dividing said case into upper and lower sections;
- a portable computer secured to said removable panel and located within the upper section of said protective case;
- a signal-conditioning unit located within the lower section of said protective case;
- a plurality-of signal processing modules connected to said signal conditioning unit; and
- a plurality of connectors connecting said portable computer to said signal processing modules and connecting said processing module to external power and data signal sources.

2. A portable data acquisition system for certifying launch system readiness on shipboard and submarine-launched weapons as in claim 1 wherein said removable panel has, on the upper surface, a plurality of switches for operating the system AC-power outlet and data connectors for said portable computer.

3. A portable data acquisition system for certifying launch system readiness on shipboard and submarine-launched weapons as in claim 1 wherein said portable computer is a personal notebook computer.

4. A portable data acquisition system for certifying launch system readiness on shipboard and submarine-launched weapons as in claim 3 wherein said personal notebook computer is a Pentium™ 75 MHz computer.

5. A portable data acquisition system for certifying launch system readiness on shipboard and submarine-launched weapons as in claim 1 wherein said plurality of signal processing modules include a 32-channel multiplexer having a cable connection to said personal computer.

6. A portable data acquisition system for certifying launch system readiness on shipboard and submarine-launched weapons as in claim 4 wherein said plurality of signal conditioning modules includes a 4-channel amplifier with excitation, a signal conditioning module, and an 8-channel isolation amplifier, each connecting to external cable connectors on said protective case.

7. A portable live data acquisition system for certifying launch system readiness on shipboard and submarine-launched weapons comprising:

a protective case;

means for collecting timing data signals, said means located within said protective case;

means for collecting data signals for torpedo physical parameters, said means located within said case; and means for processing all collected data signals and providing a go/no-go certification of a weapon and launcher.

8. A portable data acquisition system for certifying launch system readiness on shipboard and submarine-launched weapons as in claim 7 wherein said protective case further comprises a case and cover and a removable panel dividing the case into upper and lower sections.

9. A portable data acquisition system for certifying launch system readiness on shipboard and submarine-launched weapons as in claim 7 wherein said means for collecting timing data signals is a plurality of signal processing modules.

10. A portable data acquisition system for certifying launch system readiness on shipboard and submarine-launched weapons as in claim 9 wherein said plurality of signal processing modules comprise a 32-channel multiplexer connected to said means for processing all collected data.

11. A portable data acquisition system for certifying launch system readiness on shipboard and submarine-launched weapons as in claim 9 wherein said plurality of signal conditioning modules comprise of a 4-channel amplifier with excitation, a signal conditioning module, and an 8-channel isolation amplifier.

12. A portable data acquisition system for certifying launch system readiness on shipboard and submarine-launched weapons as in claim 7 wherein said software determines the following ADCAP/MK48 signal timing data fire order start and end, impulse return start, fire order to impulse return, impulse return to main motor start, main motor start (start and end), main motor start duration, service power end, weapon launch switch born, switchbox time.

13. A portable data acquisition system for certifying launch system readiness on shipboard and submarine-launched weapons as in claim 7 wherein said software determines the following TOMAHAWK signal timing parameters: ITL (start and end), Missile Enabled (start and end), Monitor/ident/DCPower (start and end), Booster Safed (start and end), Service Power (start and end).

14. A portable data acquisition system for certifying launch system readiness on shipboard and submarine-launched weapons as in claim 7 wherein said software determines the following launcher signal timing parameters: Fire Solenoid (start and end), End of Service Power to End of Fire Solenoid, Unrestrained Weapon Time, Ram Cycle Time.

15. A portable data acquisition system for certifying launch system readiness on shipboard and submarine-launched weapons as in claim 7 wherein said software determines the following breech door pressure parameters: start of rise, time at peak, rise time (peak time minus start), time at 15 psid.

16. A portable data acquisition system for certifying launch system readiness on shipboard and submarine-launched weapons as in claim 7 wherein said means for collecting torpedo physical parameters includes collecting torpedo exit velocity, peak torpedo acceleration, peak tube door pressure, and an estimate of peak torpedo acceleration based on breach door pressure correlations.

17. A portable data acquisition system for certifying launch system readiness on shipboard and submarine-launched weapons as in claim 7 wherein said means for collecting timing data signals further comprises a signal conditioning unit.

18. A portable data acquisition system for certifying launch system readiness on shipboard and submarine-launched weapons as in claim 7 wherein said means for processing all collected data utilizes a portable computer.

19. A portable data acquisition system for certifying launch system readiness on shipboard and submarine-launched weapons as in claim 15 wherein said portable computer is a personal notebook computer.

20. A portable data acquisition system for certifying launch system readiness on shipboard and submarine-launched weapons as in claim 16 wherein said personal notebook computer is at least a Pentium™ 75 Mhz computer.

21. A portable data acquisition system for certifying launch system readiness on shipboard and submarine-launched weapons as in claim 7 wherein said means for processing all collected data includes software which compares timing and physical parameters to pre-set standard values, thereby providing a go/no-go indication for a weapon and launcher.

* * * * *

UNITED STATES PATENT AND TRADEMARK OFFICE

CERTIFICATE OF CORRECTION

PATENT NO. : 6,415,211 B1
DATED : July 2, 2002
INVENTOR(S) : Dominik A. Kotlow

It is certified that error appears in the above-identified patent and that said Letters Patent is hereby corrected as shown below:

Title page, Item [54] and Column 1, lines 1 and 2,
The Title reading "WEAPON AND LAUNCHER TEST SET (WALT)" should read
-- WEAPONS AND LAUNCHER TEST SET (WALTS) --

Signed and Sealed this

Second Day of September, 2003

JAMES E. ROGAN
*Director of the United States Patent and Trademark Office*